US007681878B2

(12) United States Patent
Youn

(10) Patent No.: US 7,681,878 B2
(45) Date of Patent: Mar. 23, 2010

(54) PAPER FEEDING UNIT AND IMAGE FORMING APPARATUS HAVING THE SAME

(75) Inventor: Chang Min Youn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 57 days.

(21) Appl. No.: 12/055,355

(22) Filed: Mar. 26, 2008

(65) Prior Publication Data

US 2009/0008869 A1 Jan. 8, 2009

(30) Foreign Application Priority Data

Jul. 4, 2007 (KR) ..... 10-2007-0067043

(51) Int. Cl.
*B65H 1/10* (2006.01)

(52) U.S. Cl. ..... 271/160; 271/171

(58) Field of Classification Search ..... 271/171, 271/160, 145

See application file for complete search history.

(56) References Cited

U.S. PATENT DOCUMENTS 4,343,461 A * 8/1982 Tomimori et al. ..... 271/22
4,623,137 A * 11/1986 Irie et al. ..... 271/160
4,786,042 A * 11/1988 Stemmle ..... 271/9.1
5,238,238 A * 8/1993 Shinohara et al. ..... 271/145
5,292,117 A * 3/1994 Takagi et al. ..... 271/234
6,039,315 A * 3/2000 Lim ..... 271/160
6,182,963 B1 * 2/2001 Yergenson ..... 271/160
6,435,499 B1 * 8/2002 Tomatsu ..... 271/147
7,377,509 B2 * 5/2008 Ito ..... 271/171
2008/0093792 A1 * 4/2008 Lee et al. ..... 271/126

FOREIGN PATENT DOCUMENTS

JP 6-87540 3/1994

* cited by examiner

*Primary Examiner*—Kaitlin S Joerger
(74) *Attorney, Agent, or Firm*—Stanzione & Kim LLP

(57) ABSTRACT

A paper feeding unit and an image forming apparatus having the same capable of maintaining a constant paper feeding force regardless of a size of paper. The image forming apparatus includes a main body, a printing unit provided in the main body to form an image on paper, a paper feeding unit to supply the paper into the main body, and a force adjusting unit. The paper feeding unit includes a paper feeding cassette to load paper therein, a knock-up plate to guide the paper loaded in the paper feeding cassette to a pickup device, an elastic member to elastically bias the knock-up plate toward the pickup device, and guide sides provided at both sides of the knock-up plate. The guide sides are adjusted along a distance therebetween according to a width of the paper. The force adjusting unit adjusts an elastic force of the elastic member when the distance between the guide sides is adjusted according to a size of the paper. Accordingly, since the elastic force of the elastic member supporting the knock-up plate is adjusted through the force adjusting unit which interlocks with the guide sides moving corresponding to the change of the size of the paper loaded on the knock-up plate of the paper feeding cassette, the paper feeding force can be maintained constant all of the time.

18 Claims, 6 Drawing Sheets

PAPER FEEDING UNIT AND IMAGE FORMING APPARATUS HAVING THE SAME

CROSS-REFERENCE TO RELATED APPLICATIONS

This application claims the benefit of Korean Patent Application No. 2007-0067043, filed on Jul. 4, 2007 in the Korean Intellectual Property Office, the disclosure of which is incorporated herein by reference.

BACKGROUND OF THE INVENTION

1. Field of the Invention

The present general inventive concept relates to an image forming apparatus, and more particularly, to a paper feeding unit to supply paper to a printing unit in a main body, and an image forming apparatus having the same.

2. Description of the Related Art

Generally, an image forming apparatus, such as a laser printer, an ink-jet printer, a multi-function printer, a copying machine, or the like, includes a main body that forms an external appearance, a printing unit mounted in the main body to form an image by applying a toner or an ink to paper, a paper feeding unit to supply the paper to the printing unit, and a paper discharge unit to discharge the printed paper to the outside of the main body.

The paper feeding unit includes a paper feeding cassette or a paper feeding tray, on which the paper is loaded, and a pickup device to pickup the paper loaded on the paper loading device sheet by sheet and to feed the paper toward the printing unit. The pickup device is provided with one or more pickup rollers made of a rubber material having a large frictional coefficient. The paper feeding cassette is loaded with paper having the same size for automatic paper feeding, and is ideal for relatively large, routine print jobs. The paper feeding tray is also loaded with paper, but allows a user to swiftly and manually load one or more sheets of paper of varying sizes as needed, which makes the paper feeding tray ideal for relatively small, non-routine print jobs.

Typically, the paper feeding cassette is removably mounted in a mounting space provided in a lower portion of the main body of the image forming apparatus. A knock-up plate, on which the paper is loaded, is mounted in the paper feeding cassette. One end portion of the knock-up plate is supported by a spring, and the other end portion is hingedly coupled to a portion of the paper feeding cassette. By rotating on the hinge portion at a predetermined angle, the knock-up plate pushes up one end of the paper loaded thereon toward the pickup device.

However, in the conventional paper feeding cassette, because the knock-up plate is elastically supported by the spring with a constant elastic force all of the time, a paper feeding force of the pickup device to pick up the paper and to feed the paper to the printing unit is constant. The paper feeding force can be arithmetically derived from a frictional coefficient and a normal force of the pickup roller. The normal force is equivalent to a value of subtracting a total weight of the knock-up plate and the sheets of paper on the knock-up plate from the elastic force of the spring.

Accordingly, assuming that the elastic force of the spring and the weight of the knock-up plate are scarcely changed, the weight of the sheets of paper on the knock-up plate has a considerable influence on the paper feeding force. Such a phenomenon depends largely on a size of the paper. For example, in case of the most commonly used A4, Letter/Legal, and B5 paper, since a difference in size therebetween is very small, a large change of the paper feeding force does not occur. However, when the paper having a relatively small size, e.g., A5 paper, is used, because the weight of the sheets of paper on the knock-up plate decreases greatly, a problem occurs such that the paper feeding force considerably increases. The increase in the paper feeding force causes multiple feeding of the paper.

SUMMARY OF THE INVENTION

The present general inventive concept provides a paper feeding unit and an image forming apparatus having the same that is capable of maintaining a constant paper feeding force regardless of a size of paper being used.

Additional aspects and/or advantages of the present general inventive concept will be set forth in part in the description which follows and, in part, will be obvious from the description, or may be learned by practice of the general inventive concept.

The forgoing and/or other aspects and utilities of the present general inventive concept are achieved by providing a paper feeding unit including: a paper feeding cassette to load paper therein; a knock-up plate to guide the paper loaded in the paper feeding cassette to a pickup device; at least one elastic member to elastically bias the knock-up plate toward the pickup device; guide sides provided at both sides of the knock-up plate, the guide sides being adjusted along a distance therebetween according to a width of the paper; and at least one force adjusting unit to adjust an elastic force of a respective one of the elastic members when the distance between the guide sides is adjusted according to a size of the paper.

The at least one force adjusting unit may adjust a height of a lower end of the respective elastic member.

Each of the at least one force adjusting unit may include a lever which supports a respective one of the guide sides and a lower end of the respective elastic member. The lever may adjust a height of the lower end of the elastic member when the distance between the guide sides is adjusted.

When the distance between the guide sides increases, each of the guide sides may press down one end portion of the respective lever to increase the elastic force of the respective elastic member, and when the distance between the guide sides decreases, each of the guide sides may release the pressing on one end portion of the respective lever to decrease the elastic force of the respective elastic member.

The lever may be hingedly coupled to the paper feeding cassette so as to perform a seesaw motion.

The lower end of the elastic member may be received in a cap. The cap may be supported by the lever, and may be provided at the paper feeding cassette so as to move up and down.

The lever may be bent so as to increase a contact area between the respective guide side and the respective elastic member.

The forgoing and/or other aspects and utilities of the present general inventive concept can also be achieved by providing an image forming apparatus including: a main body; a printing unit provided in the main body to form an image on paper; a paper feeding unit to supply the paper into the main body, the paper feeding unit including a paper feeding cassette to load paper therein, a knock-up plate to guide the paper loaded in the paper feeding cassette to a pickup device, a pair of elastic members to elastically bias the knock-up plate toward the pickup device, and guide sides provided at both sides of the knock-up plate, the guide sides being adjusted along a distance therebetween according to a width of the paper; and a pair of force adjusting units to adjust an elastic force of a respective one of the elastic members when the distance between the guide sides is adjusted according to a size of the paper.

The forgoing and/or other aspects and utilities of the present general inventive concept can also be achieved by providing an image forming apparatus including: a main body; a printing unit provided in the main body to form an image on paper; a paper feeding unit to supply the paper into the main body, the paper feeding unit including a paper feeding cassette to load paper therein, a knock-up plate to guide the paper loaded in the paper feeding cassette to a pickup device, a pair of elastic members to elastically bias the knock-up plate toward the pickup device, and guide sides provided at both sides of the knock-up plate, the guide sides being adjusted in a distance therebetween according to a width of the paper; and a force adjusting unit to adjust an elastic force of each of the elastic members by changing a distance between both ends of each elastic member by interlocking with each of the guide sides when the distance between the guide sides is adjusted according to a size of the paper.

The forgoing and/or other aspects and utilities of the present general inventive concept can also be achieved by providing a recording media feeding unit, including: a media feeding cassette to load recording media therein; a knock-up plate to guide the recording media in the feeding cassette toward a pickup device; an elastic device to elastically bias the knock-up plate toward the pickup device; guide sides disposed at opposing sides of the knock-up plate to adjustably support side portions of the recording media therebetween along a width direction; and a force adjusting device to adjust an elastic force of the elastic device according to a type of the recording media loaded in the feeding cassette.

The elastic device can include two elastic members disposed between a bottom portion of the feeding cassette and a bottom surface of the knock-up plate along a width direction of the feeding cassette, each elastic member extending partly through the bottom surface of the feeding cassette.

The force adjusting device can include two force adjusting units, a first adjusting unit having a pivot axis at a bottom surface of the feeding cassette and extending from a side portion of a respective guide side to a bottom portion of a respective elastic member, and a second adjusting unit having a pivot axis at a second side of the bottom surface of the feeding cassette and extending from a side portion of a respective guide side to a bottom portion of a respective elastic member such that when each of the guide sides is adjusted, the respective adjusting unit is pivoted to adjust to a compression force in which the respective elastic member applies to the knock-up plate.

Each of the force adjusting units can include a lever having a first end portion to support a lower end of the respective guide side and a second end portion which supports a lower end of the respective elastic member, and a center shaft provided between the first end portion and the second end portion thereof.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
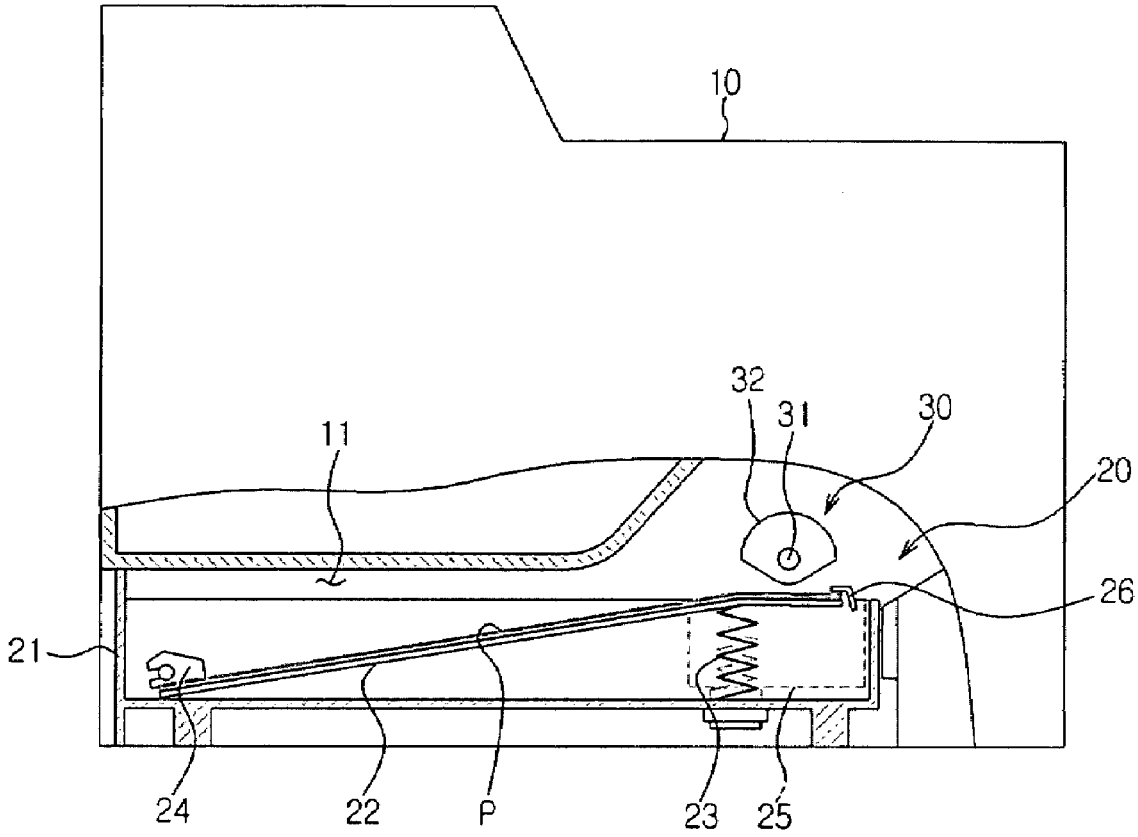
FIG. 1 is a partial cut view schematically illustrating an image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
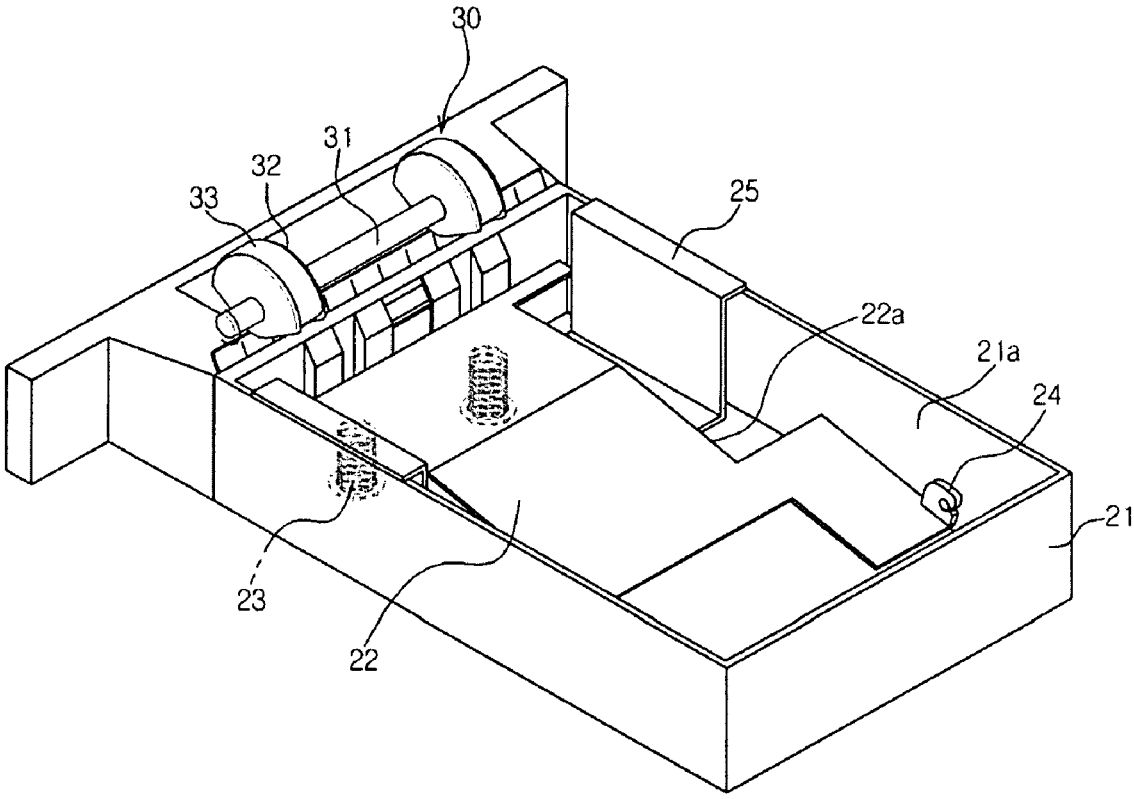
FIG. 2 is a perspective view illustrating a paper feeding unit of the image forming apparatus of FIG. 1, in accordance with an embodiment of the present general inventive concept.
Figure 3:
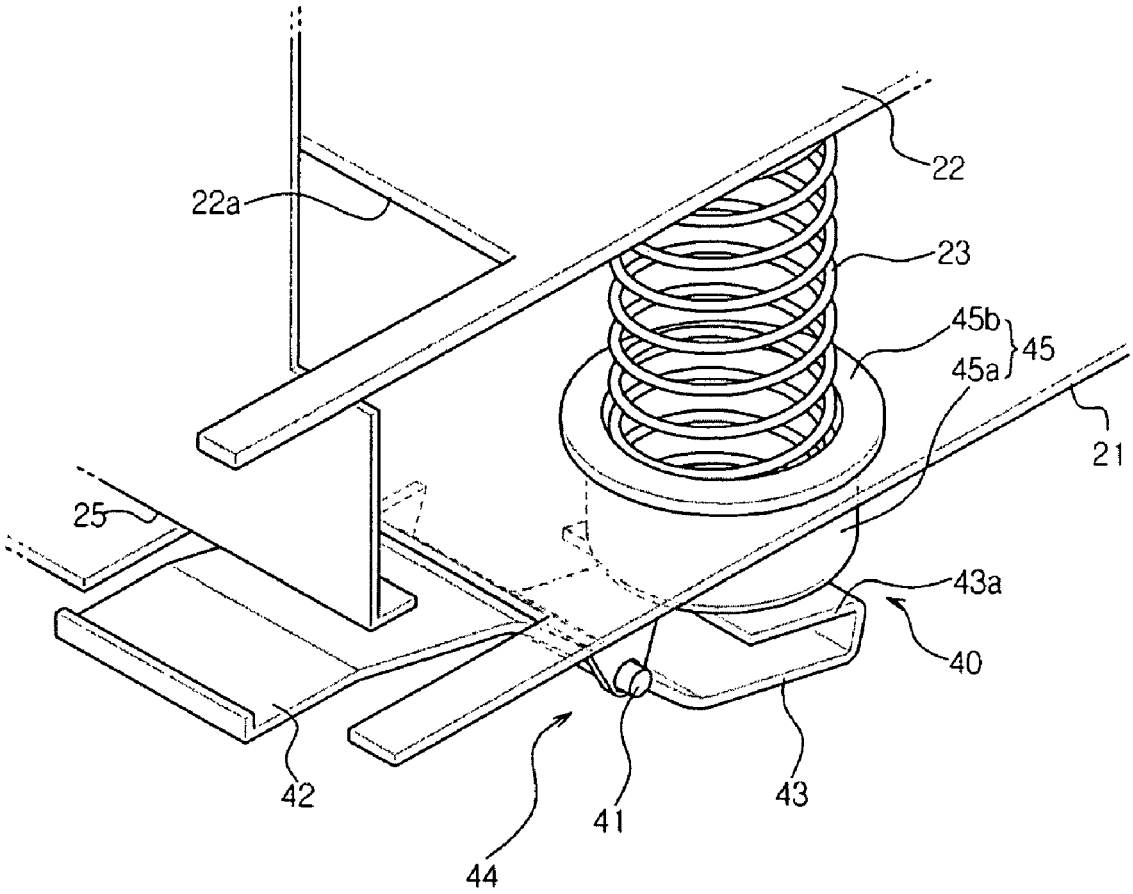
FIG. 3 is a partial perspective view of the paper feeding unit of FIG. 2, in accordance with an embodiment of the present general inventive concept.
Figure 4:
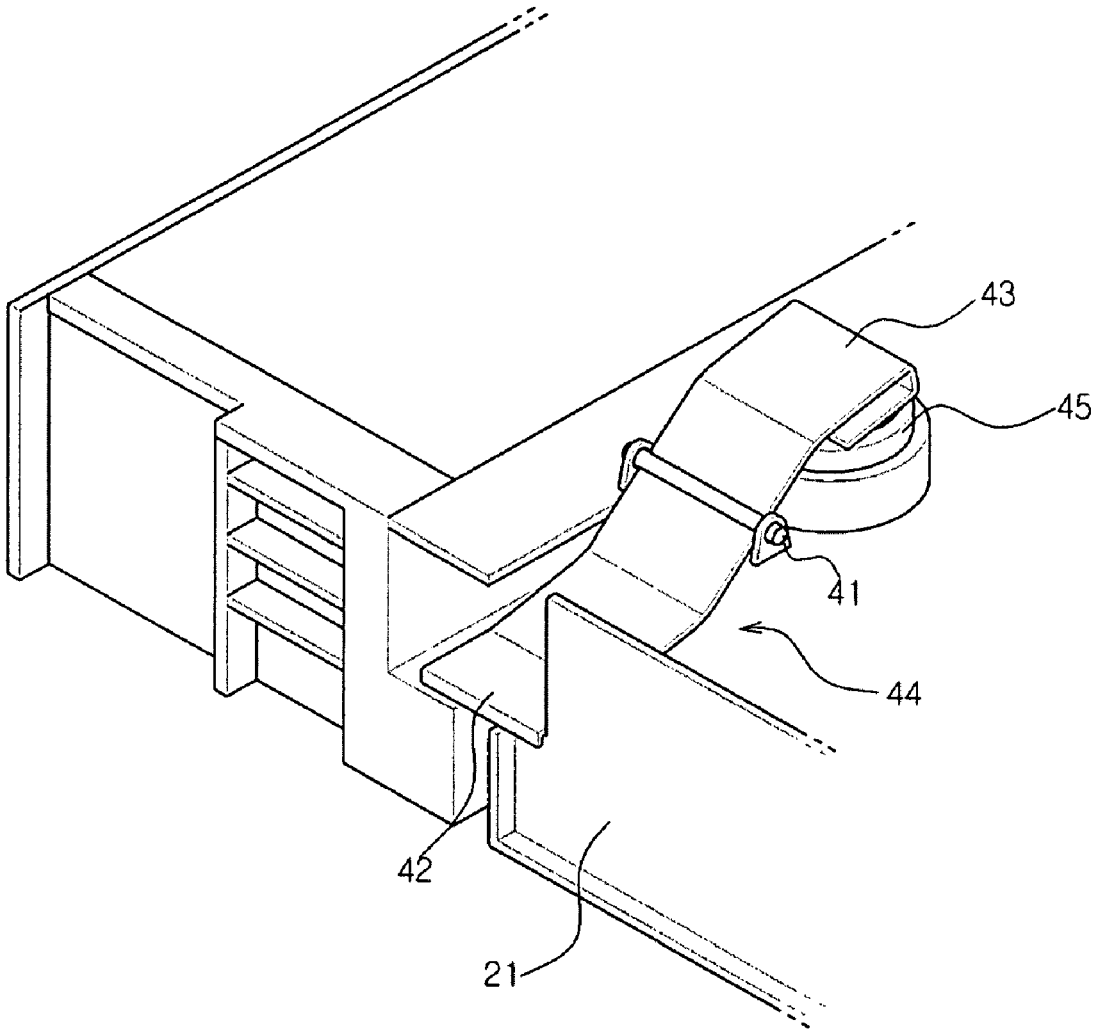
FIG. 4 is a perspective view illustrating a lower surface of a paper feeding cassette of the image forming apparatus of FIG. 1, in accordance with an embodiment of the present general inventive concept.

FIG. 1 is a partial cut view schematically illustrating an image forming apparatus according to an embodiment of the present general inventive concept, FIG. 2 is a perspective view illustrating a paper feeding unit of the image forming apparatus of FIG. 1, according to an embodiment of the present general inventive concept, FIG. 3 is a partial perspective view of the paper feeding unit of FIG. 2, according to an embodiment of the present general inventive concept, and FIG. 4 is a perspective view illustrating a lower surface of a paper feeding cassette according to an embodiment of the present general inventive concept.

Referring to the drawings, an image forming apparatus according to exemplary embodiments includes a main body 10 forming an external housing, and a paper feeding unit 20 to supply paper P into the main body 10.

Inside the main body 10 are mounted a printing unit (not shown) to print an image on the supplied paper, a discharging unit (not shown) to discharge the printed paper to the outside of the main body 10, the paper feeding unit 20, and a power device (not shown) to supply driving power to the printing unit and the discharging unit. Since the printing unit, the discharging unit and the power device are the same as in a conventional apparatus, a detailed explanation thereof will be omitted. A printing unit capable of performing a laser printing, an ink-jet printing or the like, can be employed in the image forming apparatus of the present invention.

The paper feeding unit 20 includes a paper feeding cassette 21 which is removably mounted in a mounting space 11 provided in a lower portion of the main body 10, a knock-up plate 22 which is mounted in the paper feeding cassette 21 to load paper thereon, a pickup device 30 to feed the paper loaded on the knock-up plate 22 to the printing unit sheet by sheet, and a pair of elastic members 23 to elastically bias the knock-up plate 22 toward the pickup device 30.

In order to push up one end portion of the loaded paper P toward the pickup device 30, a first end portion of the knock-up plate 22 is supported by the elastic members 23 mounted in the paper feeding cassette 21, and a second end portion is hingedly coupled to side walls 21*a* of the paper feeding cassette 21 through hinge parts 24. The knock-up plate 22 repeatedly performs up/down movement such that the first end portion of the knock-up plate 22 is pushed down by the rotating pickup device 30 when feeding the paper, and then rises up by the elastic members 23. At this time, the knock-up plate 22 pivots on the hinge parts 24 at a predetermined angle.

The knock-up plate 22 is provided with cut portions 22*a* at both sides, which are formed in a direction perpendicular to a pivoting direction on the hinge parts 24, i.e., in a width direction of the paper (refer to FIGS. 2 and 3). A pair of guide sides 25 are respectively provided within the cut portions 22*a*. In other words, each of the guide sides 25 is disposed within a respective one of the cut portions 22*a*. The pair of guide sides 25 are configured to move horizontally, so as to be adjusted along a distance therebetween according to a size of the paper and to arrange the sheets of paper loaded on the knock-up plate 22 in the width direction. The knock-up plate 22 is provided with a paper separating member 26 at an edge, which contacts an edge of the paper loaded on the knock-up plate 22 so that the paper can be fed sheet by sheet (multiple feeding is prevented) when the pickup device 30 operates.

The elastic members 23 can be configured as a common tension coil spring, one end of which is supported by a bottom surface of the paper feeding cassette 21 and the other end of which is supported by a lower surface of the first end portion of the knock-up plate 22. By the elastic members 23 elastically biasing the first end portion of the knock-up plate 22 toward the pickup device 30, the paper loaded on the knock-up plate 22 comes into contact with the pickup device 30.

The pickup device 30 includes a roller shaft 31 connected to the power device mounted in the main body 10, and a pair of pickup rollers 32 coupled to the roller shaft 31. Each of the pickup rollers 32 is provided with a friction member 33 on an outer periphery, so as to draw out the paper from the paper feeding cassette 21 during the rotation of the roller shaft 31.

As described above, depending on the vertical force of the elastic members 23 elastically biasing the knock-up plate 22, the paper feeding force, which is generated when the pickup device 30 picks up the paper loaded on the knock-up plate 22 and feeds the same, varies. To cope with this problem, the paper feeding unit 20 according to an embodiment is provided with a force adjusting unit 40 so as to maintain the paper feeding force (preferably, the vertical force, and more preferably, the elastic force of the elastic members 23) as constant regardless of the size (weight) of the paper loaded in the paper feeding cassette 21 (refer to FIG. 4).

As illustrated in FIGS. 3 and 4, the force adjusting unit 40 can be formed in a long plate shape, and includes a lever 44 having a first end portion 42 which supports a lower end of the guide side 25 and a second end portion 43 which supports a lower end of the elastic member 23, and a center shaft 41 which is provided between the first end portion 42 and the second end portion 43 of the lever 44. When the guide sides 25 are adjusted along a distance therebetween, the force adjusting unit 40 adjusts a height of the lower end of the elastic member 23. A force adjusting unit 40 is provided for each of the guide sides 25 and elastic members 23. Although FIGS. 3 and 4 illustrate a force adjusting unit 40 at one side of the lower surface of the paper feeding cassette 21, according to an embodiment of the present general inventive concept, a force adjusting unit 40 is disposed at each side of the lower surface of the paper feeding cassette 21 to extend between each of the respective guide sides 25 and elastic members 23.

As illustrated in FIG. 4, the lever 44 performs a seesaw motion about the center shaft 41, which is coupled to the lower surface of the paper feeding cassette 21, that is, the first and second end portions 42 and 43 pivot up and down in directions opposite to each other. Also, the first and second end portions 42 and 43 of the lever 44 are bent from the center shaft 41 in directions opposite to each other, so as to secure the stable operation of the lever 44 by increasing contact areas between the first end portion 42 and the guide side 25 and between the second end portion 43 and the elastic member 23. Further, the second end portion 43 of the lever 44 is formed with a base 43*a* which curvedly extends from the second end portion 43 in a U-shape to support the lower end of the elastic member 23 in a horizontal state.

So as for the second end portion 43 of the lever 44 and the elastic member 23 to contact stably with each other, a cap 45 is provided to accommodate the lower end portion of the elastic member 23. The cap 45 includes a head part 45*a* which has a cylindrical shape, and a flange part 45*b* which is formed on a top periphery of the head part 45*a*. The head part 45*a* receives the lower end portion of the elastic member 23 therein, and is supported by the bottom surface of the paper feeding cassette 21 by the flange part 45*b*. Accordingly, since the lower end of the elastic member 23 moves up and down on the bottom surface of the paper feeding cassette 21 as a result of a force applied to the cap 45 by the lever 44, the height of the lower end of the elastic member 23 varies according to the operation of the lever 44, and as a result the elastic force of the elastic member 23 varies.

Hereinafter, an operation of the above structured paper feeding unit and the image forming apparatus having the same will be described.

If the paper feeding cassette 30, in which the paper is loaded on the knock-up plate 22, is mounted in the mounting space 11 in the main body 10, one end portion of the paper loaded on the knock-up plate 22 is positioned under the pickup device 30 by the elastic members 23. Therefore, when the printing operation is started, the pickup roller 32 rotates to pull out and feed the uppermost paper from the knock-up plate 22 by using a frictional force.

Figure 5:
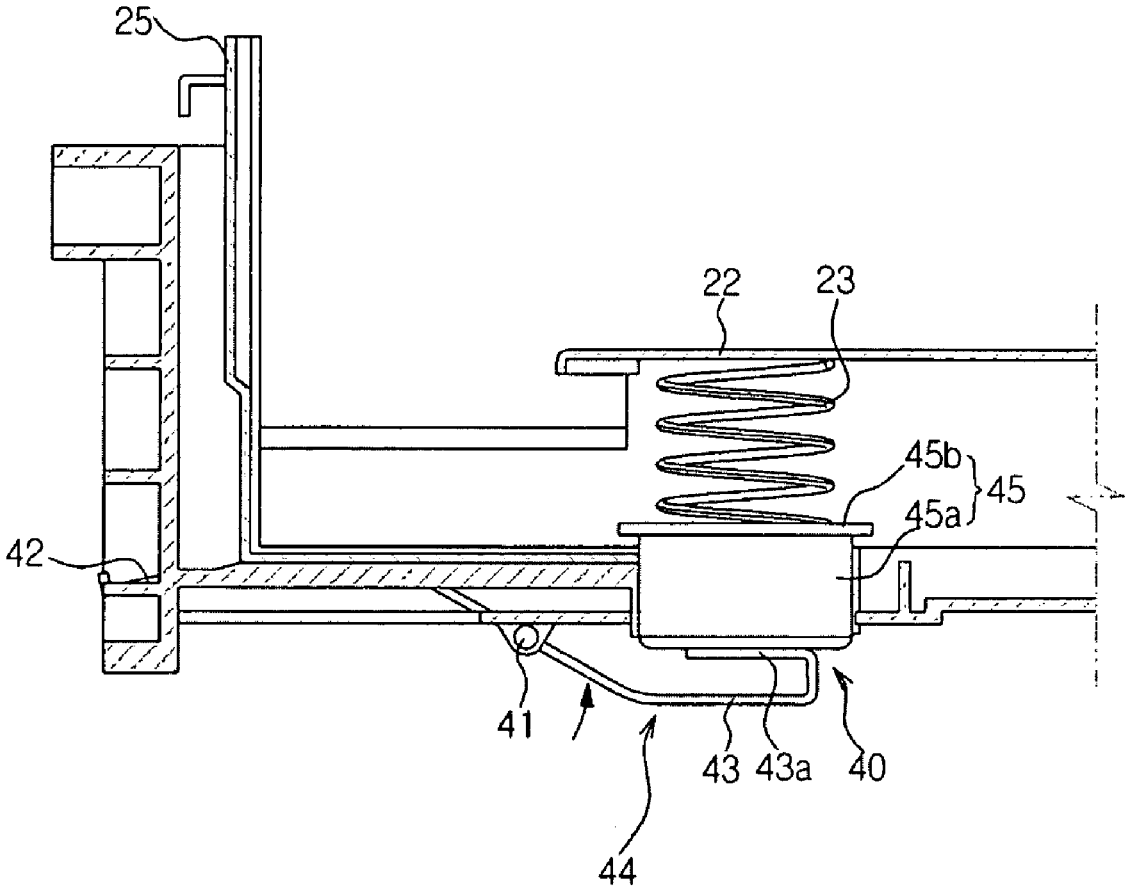
FIGS. 5 and 6 are views illustrating an exemplary operation of a paper feeding unit, in accordance with an embodiment of the present general inventive concept.

FIG. 5 illustrates a state in which the knock-up plate 22 is loaded with A4 paper or Legal/Letter paper. In such a case, since the distance between the guide sides 25 is a little bit changed and each of the guide sides 25 is in a state of pressing the first end portion 42 of the respective lever 44, the elastic force of the respective elastic members 23 supporting the knock-up plate 22 is maintained substantially constant.

Figure 6:
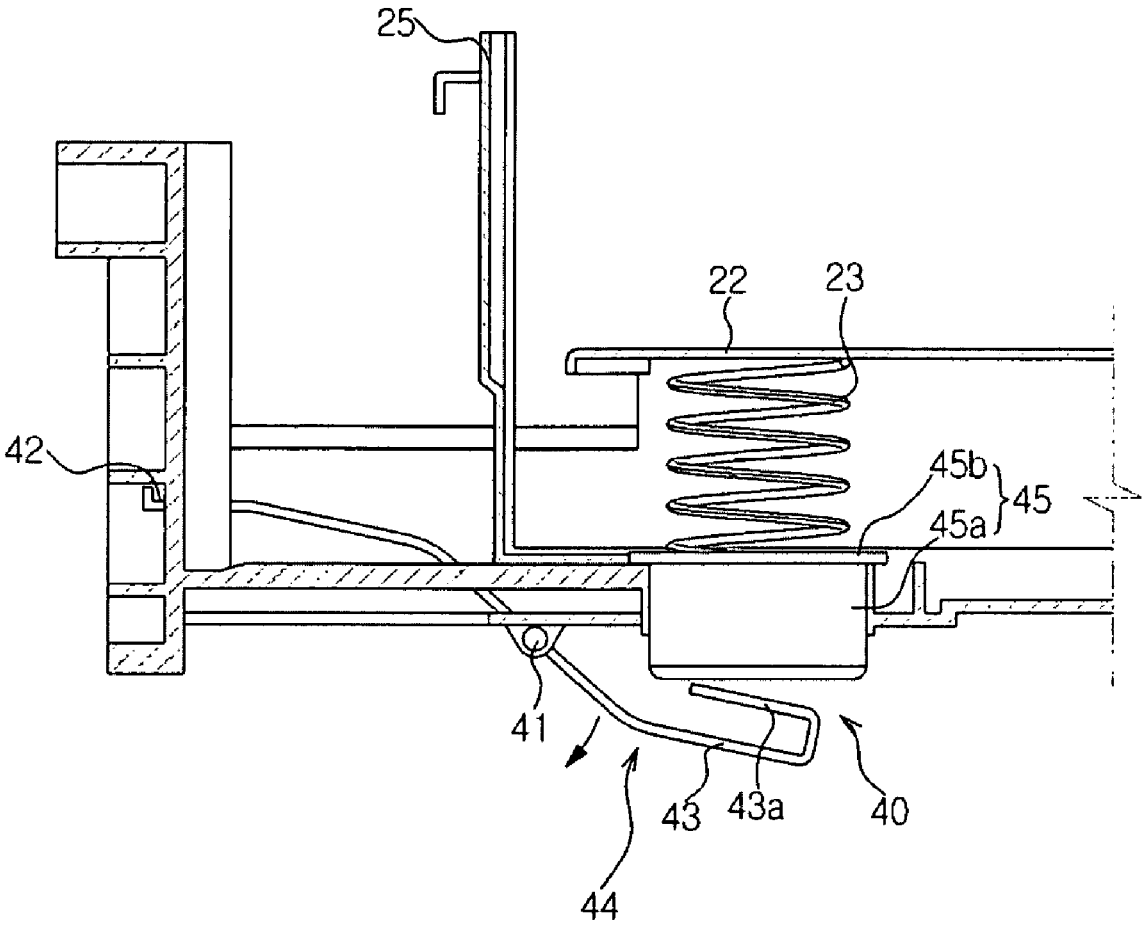

If the paper having the relatively small size, e.g., A5 paper, is loaded on the knock-up plate 22, the weight of the sheets of paper on the knock-up plate 22 decreases, and the paper feeding force of the pickup roller 32, more particularly, the elastic force of the elastic members 23 increases, which may cause a problem of multiple feeding. However, as illustrated in FIG. 6, if the guide sides 25 move inwardly to decrease the distance therebetween correspondingly to the width of the paper, the force of pressing the first end portion 42 of the lever 44 of the force adjusting unit 40 is removed, and the lever 44 rotates (i.e., the lever 44 would rotate clockwise in this case as viewed from the positioning thereof in FIG. 6). Accordingly, the supporting force of the second end portion 43 of the lever 44 on the lower end of the elastic member 23 is also removed, and the height of the lower end of the elastic member 23 decreases, that is, a distance between both ends of the elastic member 23 increases (the elastic member 23 is in an expanded state). As a result, the elastic force of the elastic members 23 decreases corresponding to the reduction of the width of the paper.

If the paper having the relatively large width is loaded on the knock-up plate 22, the guide sides 25 move outwardly to increase the distance therebetween correspondingly to the width of the paper, and the lower surface of each of the guide sides 25 presses down the first end portion 42 of the lever 44. Accordingly, the second end portion 43 of the lever 44 rises up, and the height of the lower end of the elastic member 23 increases, that is, the distance between both the ends of the elastic member 23 decreases (the state of the elastic member 23 becomes compressed). As a result, the elastic force of the elastic members 23 increases again.

As apparent from the above description, the paper feeding unit according to the present general inventive concept can maintain the paper feeding force as constant all of the time by adjusting an elastic force of elastic members supporting the knock-up plate through a force adjusting unit corresponding to the change in width of the paper loaded on the knock-up plate of the paper feeding cassette.

Further, since the force adjusting unit is configured such that a lever supports the guide side and a lower end of an elastic member at both the ends and interlocks with the adjustment of the distance between the guide sides corresponding to the change of the size of the paper, the elastic force of the elastic members can be easily adjusted, and a paper feeding force can be maintained as constant and stable with a simple structure.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. A paper feeding unit comprising:

a paper feeding cassette to load paper therein;

a knock-up plate to guide the paper loaded in the paper feeding cassette to a pickup device;

at least one elastic member to elastically bias the knock-up plate toward the pickup device;

guide sides provided at both sides of the knock-up plate, the guide sides being adjusted along a distance therebetween according to a width of the paper; and at least one force adjusting unit to adjust an elastic force of a respective one of the elastic members when the distance between the guide sides is adjusted according to a size of the paper, wherein the at least one force adjusting unit adjusts a height of a lower end of the respective elastic member.

2. The paper feeding unit according to claim 1, wherein each of the at least one force adjusting unit includes a lever which supports a respective one of the guide sides and a lower end of the respective elastic member, and wherein the lever adjusts a height of the lower end of the elastic member when the distance between the guide sides is adjusted.

3. The paper feeding unit according to claim 2, wherein when the distance between the guide sides increases, each of the guide sides presses down one end portion of the respective lever to increase the elastic force of the respective elastic member, and when the distance between the guide sides decreases, each of the guide sides releases the pressing on one end portion of the respective lever to decrease the elastic force of the respective elastic member.

4. The paper feeding unit according to claim 2, wherein the lever is hingedly coupled to the paper feeding cassette so as to perform a seesaw motion.

5. The paper feeding unit according to claim 2, wherein the lower end of the elastic member is received in a cap, and wherein the cap is supported by the lever, and is provided at the paper feeding cassette so as to move up and down.

6. The paper feeding unit according to claim 2, wherein the lever is bent to increase a contact area between the respective guide side and the respective elastic member.

7. The paper feeding unit according to claim 1, wherein the distance between the guide sides is adjusted according to a width of the paper.

8. An image forming apparatus comprising:

a main body;

a printing unit provided in the main body to form an image on paper;

a paper feeding unit to supply the paper into the main body, the paper feeding unit including a paper feeding cassette to load paper therein, a knock-up plate to guide the paper loaded in the paper feeding cassette to a pickup device, a pair of elastic members to elastically bias the knock-up plate toward the pickup device, and guide sides provided at both sides of the knock-up plate, the guide sides being adjusted along a distance therebetween according to a width of the paper; and a pair of force adjusting units to adjust an elastic force of a respective one of the elastic members when the distance between the guide sides is adjusted according to a size of the paper, wherein the pair of force adjusting units adjusts a height of a lower end of the respective one of the elastic member.

9. The image forming apparatus according to claim 8, wherein each force adjusting unit includes a lever to support a respective one of the guide sides and a lower end of the respective elastic member, and wherein the lever adjusts a height of the lower end of the respective elastic member when the distance between the guide sides is adjusted.

10. The image forming apparatus according to claim 9, wherein when the distance between the guide sides increases, each of the guide sides presses down one end portion of the respective lever to increase the elastic force of the respective elastic member, and when the distance between the guide sides decreases, each of the guide sides releases the pressing on one end portion of the respective lever to decrease the elastic force of the respective elastic member.

11. The image forming apparatus according to claim 9, wherein the lower end of each elastic member is received in a cap, and wherein the cap is supported by the lever, and is provided at the paper feeding cassette to move up and down.

12. The image forming apparatus according to claim 9, wherein each lever is bent to increase a contact area between the respective guide side and elastic member.

13. An image forming apparatus comprising:

a main body;

a printing unit provided in the main body to form an image on paper;

a paper feeding unit to supply the paper into the main body, the paper feeding unit including a paper feeding cassette to load paper therein, a knock-up plate to guide the paper loaded in the paper feeding cassette to a pickup device, a pair of elastic members to elastically bias the knock-up plate toward the pickup device, and guide sides provided at both sides of the knock-up plate, the guide sides being adjusted in a distance therebetween according to a width of the paper; and a force adjusting unit to adjust an elastic force of each of the elastic members by changing a distance between both ends of each elastic member by interlocking with each of the guide sides when the distance between the guide sides is adjusted according to a size of the paper, wherein the force adjusting unit adjusts a height of a lower end of the elastic member.

14. The image forming apparatus according to claim 13, wherein the force adjusting unit includes a pair of levers, each lever having a first end portion and a second end portion which support a respective one of the guide sides and a lower end of a respective one of the elastic member, and each lever is hingedly coupled to the paper feeding cassette to perform a seesaw motion.

15. The image forming apparatus according to claim 14, wherein when the distance between the guide sides increases, each of the guide sides presses down the first end portion of the respective lever to increase the elastic force of the respective elastic member, and when the distance between the guide sides decreases, each of the guide sides releases the pressing on the first end portion of the respective lever to decrease the elastic force of the respective elastic member.

16. A recording media feeding unit, comprising:

a media feeding cassette to load recording media therein;

a knock-up plate to guide the recording media in the feeding cassette toward a pickup device;

an elastic device to elastically bias the knock-up plate toward the pickup device;

guide sides disposed at opposing sides of the knock-up plate to adjustably support side portions of the recording media therebetween along a width direction; and a force adjusting device to adjust an elastic force of the elastic device according to a type of the recording media loaded in the feeding cassette, wherein the force adjusting device adjusts a height of a lower end of the elastic device.

17. The recording media feeding unit according to claim 16, wherein the elastic device comprises two elastic members disposed between a bottom portion of the feeding cassette and a bottom surface of the knock-up plate along a width direction of the feeding cassette, each elastic member extending partly through the bottom surface of the feeding cassette.

18. The recording media feeding unit according to claim 17, wherein the force adjusting device comprises two force adjusting units, a first adjusting unit having a pivot axis at a bottom surface of the feeding cassette and extending from a side portion of a respective guide side to a bottom portion of a respective elastic member, and a second adjusting unit having a pivot axis at a second side of the bottom surface of the feeding cassette and extending from a side portion of a respective guide side to a bottom portion of a respective elastic member such that when each of the guide sides is adjusted, the respective adjusting unit is pivoted to adjust to a compression force in which the respective elastic member applies to the knock-up plate.

* * * * *